United States Patent [19]

Henryson

[11] 4,139,185

[45] Feb. 13, 1979

[54] LANCE MANIPULATOR

[75] Inventor: Leif A. Henryson, Mörarp, Sweden

[73] Assignee: Kockums Construction AB

[21] Appl. No.: 859,586

[22] Filed: Dec. 12, 1977

[30] Foreign Application Priority Data

Dec. 14, 1976 [SE] Sweden ..... 7614042

[51] Int. Cl.[2] ..... C21C 7/00

[52] U.S. Cl. ..... 266/226

[58] Field of Search ..... 266/216, 217, 225, 226; 214/1 BC, 2.5

[56] References Cited

U.S. PATENT DOCUMENTS

| | | | |
|---|---|---|---|
| 51,397 | 12/1865 | Bessemer | 266/226 |
| 3,336,991 | 8/1967 | Klem et al. | 214/2.5 |
| 3,985,189 | 10/1976 | Jahnke et al. | 214/2.5 |

*Primary Examiner*—Gerald A. Dost

[57] ABSTRACT

The disclosure relates to a manipulator for an immersion lance for the injection of finely-divided additive material into a melt. The manipulator is provided with a pivotal lance frame on which a lance is supported such that it may be raised and lowered. The lance frame cooperates with a lance magazine for the replacement of a lance, the lance magazine having a plurality of pipes each for accommodating one lance.

1 Claim, 4 Drawing Figures

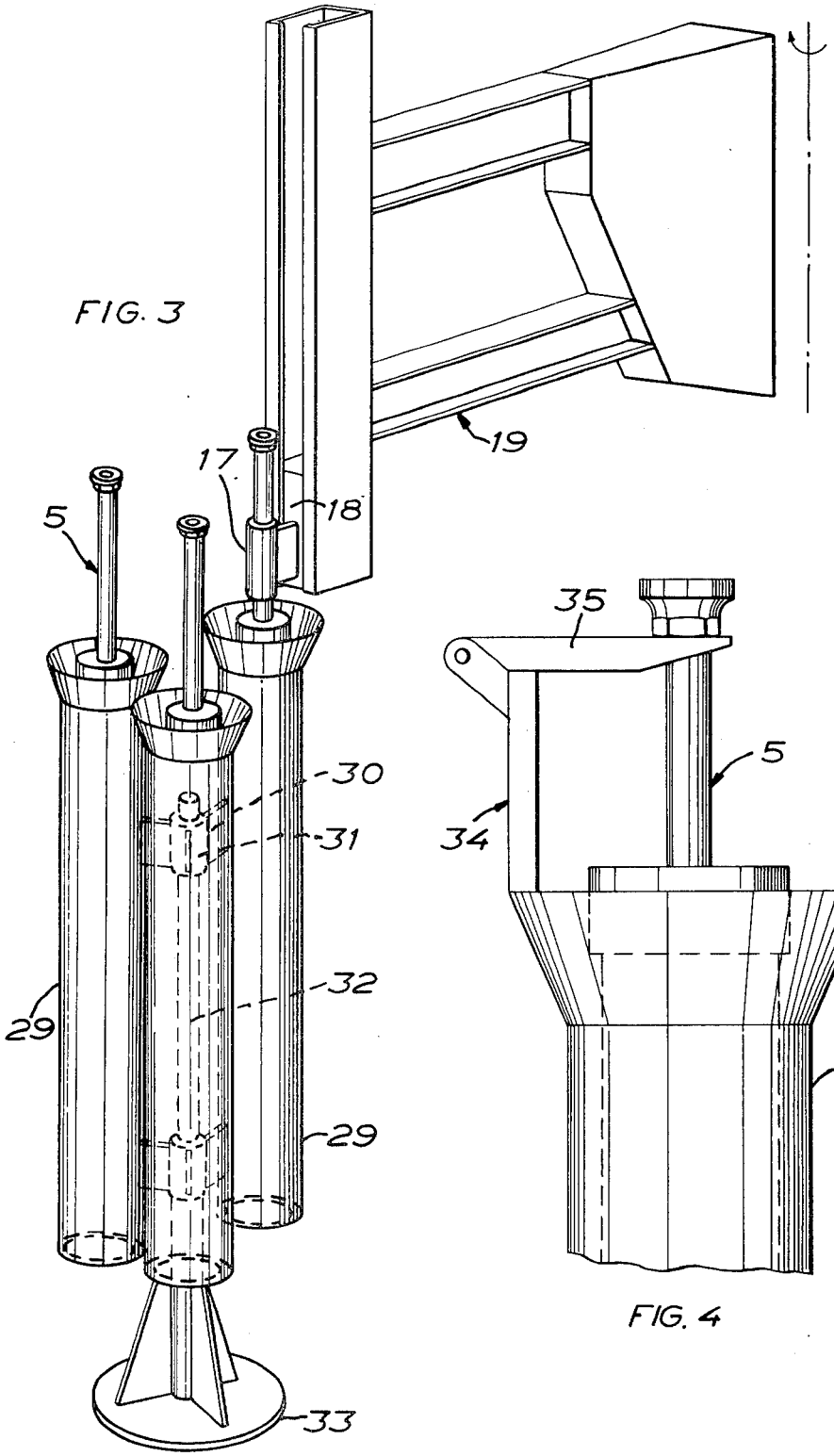
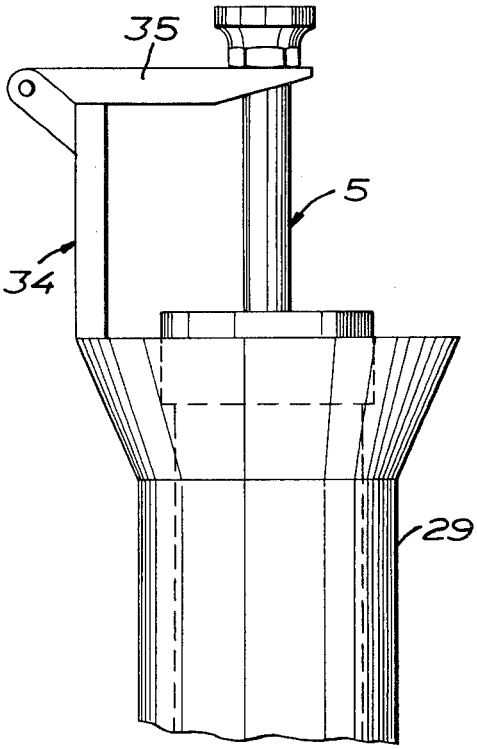
FIG. 4

LANCE MANIPULATOR

The present invention relates to a manipulator for an immersion lance for the injection of finely-divided additive materials into a melt, primarily a metal melt, the manipulator comprising a lance frame on which the lance may be raised and lowered.

Charging of a melt with additive materials, for example, lime for desulphurizing iron, steel etc. or metallic powder for alloying the melt, is normally carried out in that the additive material is fed from a storage container through a pneumatic conveyor and a conduit to an immersion lance with a nozzle which discharges within the melt. As a rule, the charging is carried out while the melt is in a ladle to which the melt had previously been transferred from a furnace. The available time for treating the melt in the ladle is then restricted, since if it is to be possible to process the melt further, the melt may not cool below a certain temperature.

By the use of an immersion lance, an effective utilization of the additive material is realized and the treatment can normally be kept to within the restricted treatment time. However, the lance may occasionally break, even though it is normally used only once. In such an event, the break almost always occurs at the surface of the melt so that a portion of the lance sinks to the bottom of the ladle, the stump remaining on the lance frame. In order, in such an event, that it be possible to carry out the contemplated treatment of the melt within the restricted time available, it is necessary that the lance stump remaining on the lance frame rapidly be replaced with a new, whole lance. Earlier, lance replacement has been carried out for each treatment and has been a circumstantial operation when the ladle is in the operative position.

The object of the present invention is, therefore, to produce a manipulator which makes possible rapid lance replacement so that the treatment of the melt can be kept to within the restricted treatment time even in the event of lance breakage.

To this end, the manipulator disclosed by way of introduction is provided with a lance magazine with a plurality of pipes, a lance being supported in each one of the pipes, the lance frame of the manipulator being movable between a position above the melt and a lance magazine position, in which latter position a lance in the lance magazine may be directly grasped by the raisable and lowerable holder of the manipulator.

The nature of the present invention and its aspects will be more readily understood from the following description of the accompanying drawings, and discussion relating thereto.

In the accompanying drawings:

FIG. 3 is a perspective view of the lance frame and lance magazine; and

FIG. 4 illustrates a detail of the lance magazine.

Figure 1:
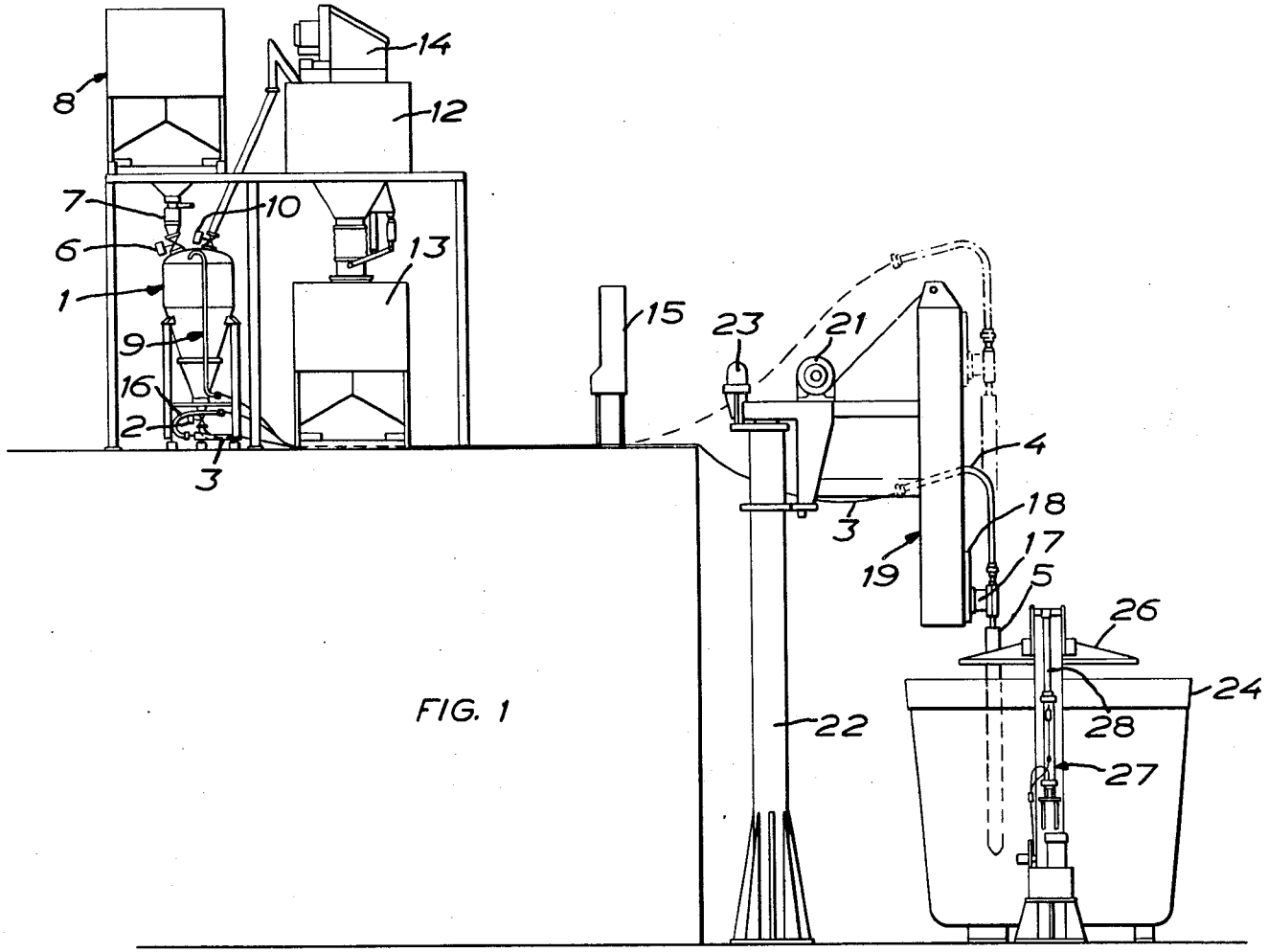
FIG. 1 is a side elevation of an installation for the injection of additive material into a melt.

The injection installation illustrated in FIG. 1 comprises an additive material container 1 with a conical lower section whose apex has an opening which is in communication by the intermediary of a valve 2 with one end of a supply conduit 3, whose other end is connected to a connection pipe 4 on which a lance 5 is mounted. The container 1 is connected, by the intermediary of a valve 6 and a pipe 7 to a storage container 8 for the additive material. The container 1 may be placed under pressure, by the intermediary of a conduit 9 connected to a source of gas under pressure (not shown), the conduit discharging in the upper region of the container 1, for forcing out the additive material in the container to the melt. Finally, the container 1 is connected, by the intermediary of a valve 10 and a conduit 11, to a receptacle 12 which is in communication, by the intermediary of a bellows pipe, with a container 13 which may be identical to the storage container 8. The receptacle 12 is in communication with the atmosphere via a filter 14.

The operation of the installation can be controlled and supervised from an instrument and operating panel 15. In brief, the function of the above-described section of the installation is as follows. When the valve 6 is opened, additive material can be filled into the container 1 from the storage container 8. The added amount of additive material is displayed on the panel 15, load transducers located beneath the legs of the container 1 being utilized. With the valves 6 and 10 closed, the container 1 is placed under pressure via the conduit 9. When the valve 2 is then opened to a suitable degree and the pressure in the container 1 is regulated accordingly, a selected amount of the additive material can be fed at the desired rate out from the container 1 through the conduit 3, the connection pipe 4 and the lance 5 into the interior of the melt.

For renewed filling of the container 1, the pressure is lowered in that the valve 10 is opened, the gas under pressure flowing, via the conduit 11 and receptacle 12, out through the filter 14, whereas any possible additive material accompanying the flow is collected in the container 13.

In order to empty the conduit 3 and connection pipe 4 of residual material when, for example, the additive material is to be changed, a conduit 16, connected to the source of gas under pressure, is coupled to the conduit 3 at its connection with the valve 2.

Figure 2:
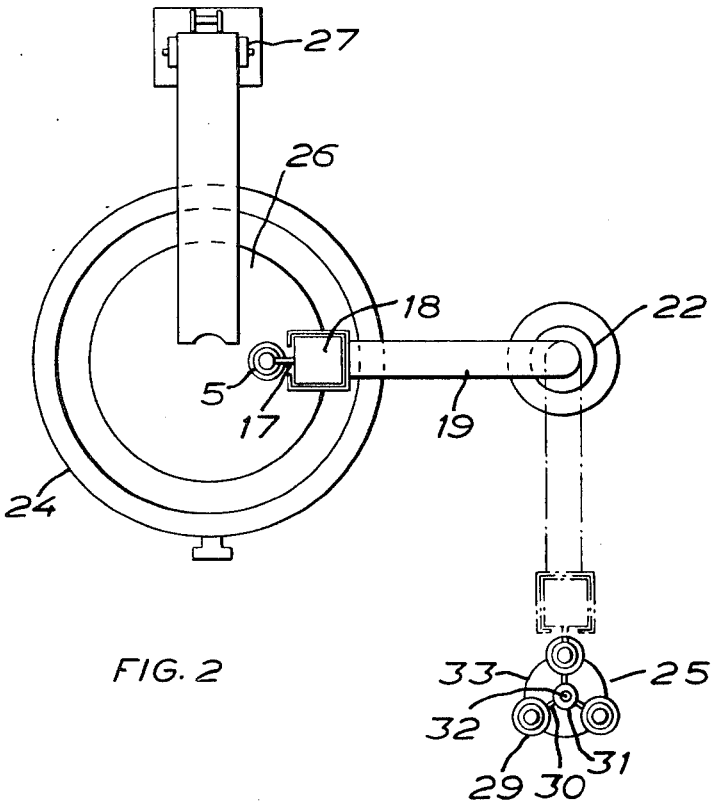
FIG. 2 is a schematic plan view of the lance frame.

The lance 5 is carried by a holder 17 which is fixed to a weight 18, the weight being guided by vertical guides on a lance frame 19. The weight 18 is suspended from a cable 20 and can, via the cable, be lowered or raised by means of an electric motor 21 controlled from the panel 15. The lance frame 19 is rotatably journalled on a swinging wall jib crane 22 and can, by means of an electric motor 23 which is also controlled from the panel 15, be swung to and fro between the position, shown in FIG. 1, above the melt in a ladle 24 and the position, shown in FIG. 2 by means of broken lines, at a lance magazine 25. During this swinging movement, the weight 18 and the lance 5 assume, naturally, the upper position intimated in FIG. 1 by means of dash-dot lines.

As is apparent from FIG. 1, a protective hood 26 with a wicket for the passage of the lance 5 is disposed above the ladle 24. The hood 26 is journalled to a frame 27 and may be pivoted, by means of a link 28 and some suitable drive means controlled from the panel 15, between the illustrated horizontal position and a substantially vertical position, in which the ladle 24 is accessible for movement.

The preferred embodiment of the lance magazine 25, illustrated in FIG. 3, comprises three magazine pipes 29 which are rotatably supported, by means of arms 30 and sleeves 31, on a vertical shaft 32 with a foot 33. The pipes 29 are open at their bottom end (where heating can be effected by means of gas) and at their upper end.

The upper end is slightly flared and supports, as is shown only in FIG. 4, an upright 34 on which an arm 35, with a recess for supporting the lance 5, is journalled so as to be freely pivotal upwardly from a horizontal position in abutment with the upper end of the upright 34.

The above-described lance manipulator works in the following way. When the ladle 24 has been put in place, for example by means of an overhead crane, beside the protective hood frame 27, the protective hood 26 is first lowered and the lance 5 is then lowered through the wicket in the protective hood 26 down into the melt. The previously described injection of additive material can thereafter be commenced. If the lance 5 were to break during this injection process, the injection process is, naturally, discontinued and the remaining stump of the lance 5 is lifted out with the holder 17 by means of the motor 21. The lance frame 19 is thereafter swung by means of the motor 23 in a direction towards the lance magazine 25, during which swinging movement the stump of the lance 5 can be disconnected from the connection pipe 4 and from the holder 17 and be released at a suitable point. When the lance frame 19 reaches the lance magazine 25, the holder 17 is depressed to its lower position and caused to grasp one of the lances 5 in the magazine 25. At the same time, the connection pipe 4 is coupled to the grasped, new lance 5. The holder 17 is then raised, the arm 35 being lifted up by the ceramic casing of the lance 5 until such time as the grasped lance 5 is free from the pipe 29, whereafter the lance frame 19 is swung back to its position above the ladle 24 and the new lance 5 is lowered into the melt. The injection of additive material can then be recommenced and concluded.

It will be appreciated by the skilled reader that the above-described device according to the invention makes possible a rapid lance replacement, this in particular if the holder 17 is controllable from the panel 15 and the coupling between the lance 5 and the connection pipe 4 is a rapid coupling. Since the invention ensures that the restricted time for treatment of the melt in the ladle 24 is not exceeded, it is even possible that each lance 5 could be used several times, until such time as it breaks, instead of being replaced, as is the present situation, for each new melt which is to be treated.

Many modifications of the above-described embodiment are naturally possible within the scope of the present invention. Thus, the lance magazine 25 can be designed in other ways, provided that a new and heated lance 5 in a lance magazine position is always available for transfer to the lance frame 19.

What I claim and desire to secure by Letters Patent is:

1. A manipulator for an immersion lance injection of finely-divided additive material into a melt, primarily a metal melt, said manipulator comprising a lance frame with a holder for the lance which may be raised and lowered including a lance magazine with a plurality of pipes which are vertically disposed and rotatably journalled about a common vertical shaft with each pipe having, at its upper end, a lance supporting arm which is freely pivotal upwardly from a substantial horizontal arrest position, one lance being supported in each of said pipes by said lance supporting arm, with said lance frame being movable between a position above the melt and a lance magazine position such that when in the latter position one lance may be directly grasped by the holder.

* * * * *